US009627830B1

(12) United States Patent
Wronski et al.

(10) Patent No.: US 9,627,830 B1
(45) Date of Patent: Apr. 18, 2017

(54) RECEPTACLE COMPATIBLE WITH MULTIPLE TYPES OF LAMP SOCKETS

(71) Applicants: Grzegorz Wronski, Peachtree City, GA (US); Jared Michael Davis, Newnan, GA (US); Rongxiu Huang, III, Shanghai (CN)

(72) Inventors: Grzegorz Wronski, Peachtree City, GA (US); Jared Michael Davis, Newnan, GA (US); Rongxiu Huang, III, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/808,913

(22) Filed: Jul. 24, 2015

Related U.S. Application Data

(60) Provisional application No. 62/028,457, filed on Jul. 24, 2014, provisional application No. 62/036,293, filed on Aug. 12, 2014.

(51) Int. Cl.
*H01R 27/00* (2006.01)
*H01R 33/08* (2006.01)
*F21V 19/00* (2006.01)

(52) U.S. Cl.
CPC ..... *H01R 33/08* (2013.01); *F21V 19/00* (2013.01); *H01R 27/00* (2013.01)

(58) Field of Classification Search
CPC ..... H01R 13/35; H01R 25/006; H01R 27/00; H01R 29/00; H01R 35/02; H01R 24/76; H01R 11/24
USPC ..... 439/222–224, 227–228
See application file for complete search history.

(56) References Cited

U.S. PATENT DOCUMENTS 4,739,460 A * 4/1988 Kelsall ..... F21V 21/04 362/365
5,154,628 A * 10/1992 Skegin ..... H01R 33/46 439/336
5,823,829 A * 10/1998 Suzuki ..... H01R 33/05 439/665
6,000,818 A * 12/1999 Caluori ..... F21V 21/04 362/147
6,168,299 B1 * 1/2001 Yan ..... F21S 8/02 362/216
6,227,912 B1 * 5/2001 Hung ..... H01R 33/9555 200/51.17
6,361,193 B1 * 3/2002 Gabrius ..... F21S 8/02 362/147
6,364,511 B1 * 4/2002 Cohen ..... F21S 8/02 362/148
8,110,973 B2 * 2/2012 Richard ..... H01J 5/48 313/113
8,733,962 B1 * 5/2014 Leslie ..... F21V 7/041 362/148

(Continued)

*Primary Examiner* — Chandrika Prasad
(74) *Attorney, Agent, or Firm* — King & Spalding LLP

(57) ABSTRACT

A lighting system can comprise a receptacle for mounting and supplying electricity to a lamp. The receptacle can be compatible with multiple types of lamp sockets. For example, the receptacle can be compatible with two types of lamp sockets that utilize spring force for socket retention in the receptacle. In one such lamp socket type, a spring clip retains the lamp socket in the receptacle utilizing outward spring force. In another such lamp socket type, a spring clip retains the lamp socket in the receptacle utilizing inward spring force.

17 Claims, 14 Drawing Sheets

(56) References Cited

U.S. PATENT DOCUMENTS

| | | | | |
|---|---|---|---|---|
| 2003/0223240 | A1* | 12/2003 | Houle | F21V 21/04 362/364 |
| 2008/0068847 | A1* | 3/2008 | Bedard | F21S 8/02 362/365 |
| 2008/0232116 | A1* | 9/2008 | Kim | F21S 8/026 362/365 |
| 2011/0234081 | A1* | 9/2011 | Adams | F21K 9/1375 313/318.01 |
| 2011/0267826 | A1* | 11/2011 | Santiago | F21V 21/048 362/365 |
| 2013/0038230 | A1* | 2/2013 | Brown | H05B 33/0815 315/201 |
| 2014/0254138 | A1* | 9/2014 | Midy | H01R 33/09 362/95 |
| 2015/0204522 | A1* | 7/2015 | Baumeister | F21K 9/27 362/217.16 |

* cited by examiner

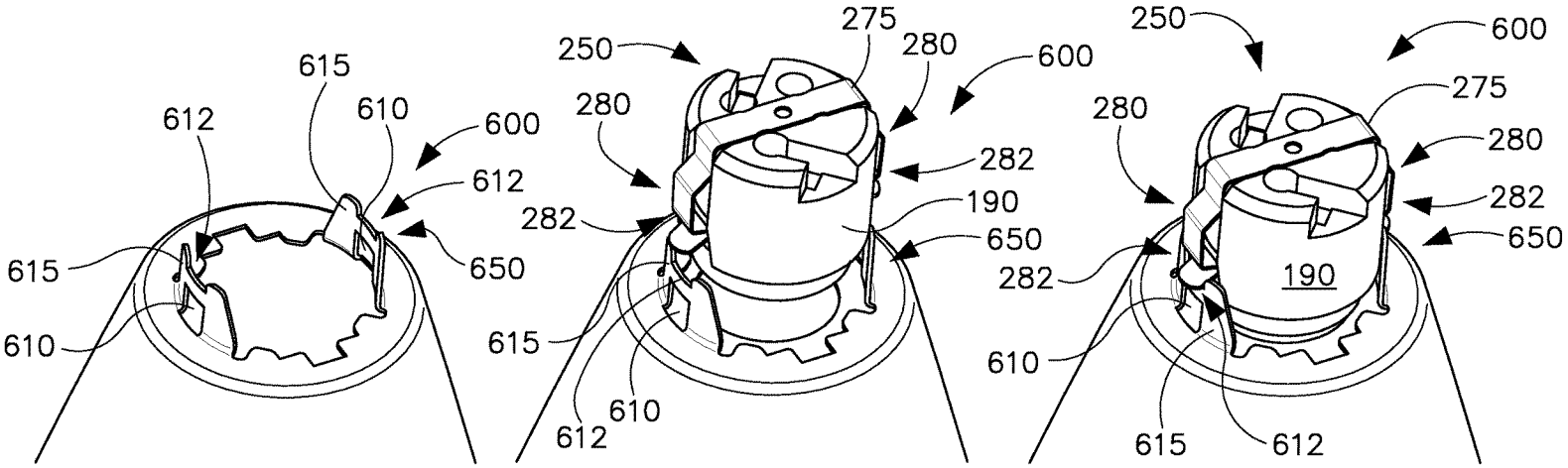
FIG. 7A
FIG. 7B
FIG. 7C
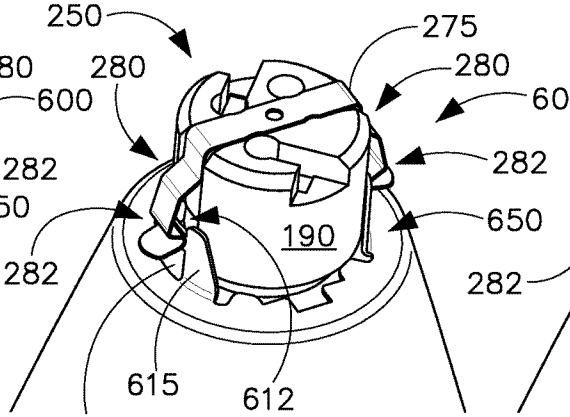
FIG. 7D
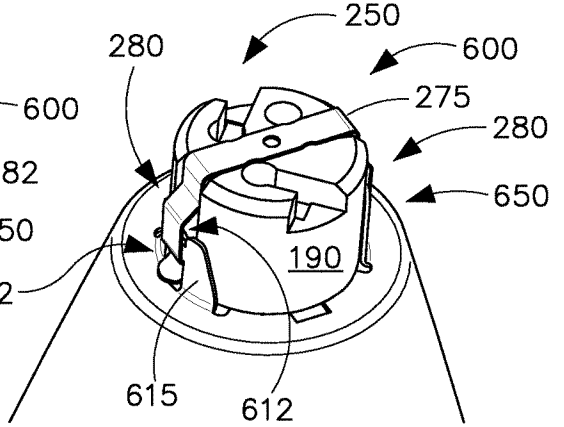
FIG. 7E
FIG. 7F

RECEPTACLE COMPATIBLE WITH MULTIPLE TYPES OF LAMP SOCKETS

CROSS REFERENCE TO RELATED APPLICATIONS

This application claims priority to U.S. Provisional Patent Application No. 62/028,457 filed Jul. 24, 2014 in the name of Grzegorz Wronski, Jared Michael Davis, and Rongxiu Huang III and entitled "Lamp Socket Connection System," the entire contents of which are hereby incorporated herein by reference; this application further claims priority to U.S. Provisional Patent Application No. 62/036,293 filed Aug. 12, 2014 in the name of Grzegorz Wronski, Jared Michael Davis, and Rongxiu Huang III and entitled "Lamp Socket Connection System," the entire contents of which are hereby incorporated herein by reference.

TECHNICAL FIELD

Embodiments of the technology relate generally to light source mounting, and more particularly to a lamp socket that utilizes a spring clip for retention in a receptacle or socket interface.

BACKGROUND

A lighting fixture may incorporate a socket for mounting and powering a lamp. For example, a lighting fixture may include facilities for mounting a light bulb to emit illumination for a room or other area. However, conventional lamp-mounting facilities often lack sufficient flexibility to accommodate diverse applications, installation configurations, bulb styles, and user preferences.

Accordingly, there are needs in the art for improved lamp mounting. For example, need exists for a lamp mounting system that can accommodate multiple types of lamp sockets. Need also exists for a lamp mounting system that can provide multiple lamp mounting positions. Need exists for a lamp mounting system that provides improved flexibility. Need further exists for a lamp mounting system that can accommodate multiple lamp sizes or styles. A capability addressing one or more such needs, or some other related deficiency in the art, would support improved lighting.

SUMMARY

In one aspect of the disclosed technology, a receptacle can be compatible with multiple types of lamp sockets. In one such lamp socket type, a spring retains a lamp socket in the receptacle utilizing outward spring force. In another such lamp socket type, a spring retains a lamp socket in the receptacle utilizing inward spring force. A lighting fixture can comprise the receptacle, for example, the receptacle can be incorporated in a finishing section of a lighting fixture.

The foregoing discussion is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 2A:
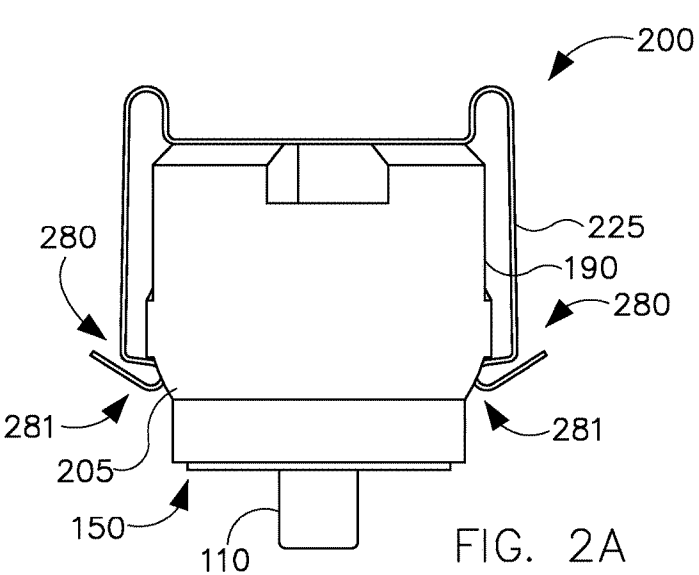
FIGS. 2A, 2B, and 2C (collectively FIG. 2) illustrate lamp sockets comprising spring clips that press against the side of the socket according to some example embodiments.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

Some representative embodiments will be described hereinafter with example reference to the accompanying drawings. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

Figure 1:
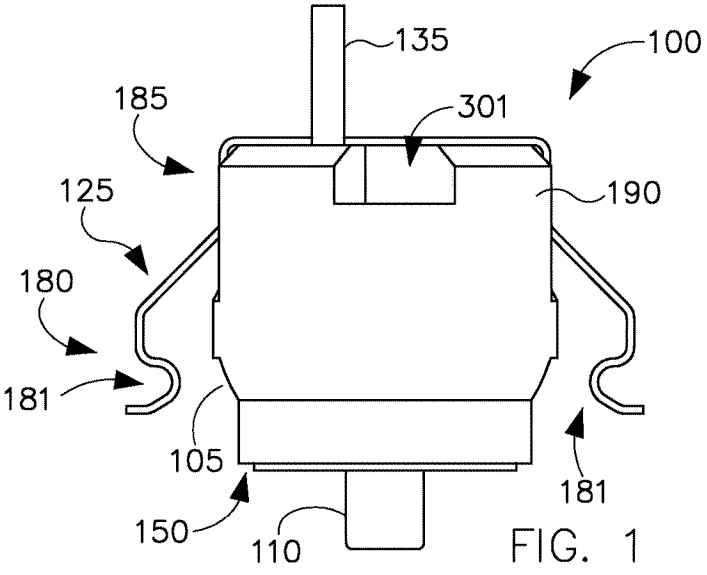
FIG. 1 illustrates a lamp socket comprising a spring clip that is splayed out when relaxed according to some example embodiments.

Turning now to FIG. 1, this figure illustrates a lamp socket 100 that comprises a splayed out spring clip 125. In an example embodiment, the illustrated lamp socket 100 is compatible with conventional E26 light bulbs and thus may be characterized as an E26 lamp socket. The lamp socket 100 may further be characterized as an example of an "Edison screw" or "ES" socket.

As illustrated, the lamp aperture 150 of the lamp socket 100 (which is typically threaded) is plugged with a protective plug 110 to reject installation debris and worksite paint. Once the socket 100 installed, the protective plug 110 would be removed and replaced with a lamp. Electrical contacts within the lamp aperture 150 of the lamp socket 100 supply electricity to a lamp when a lamp is inserted.

Figures 3A, 3B, 3C:
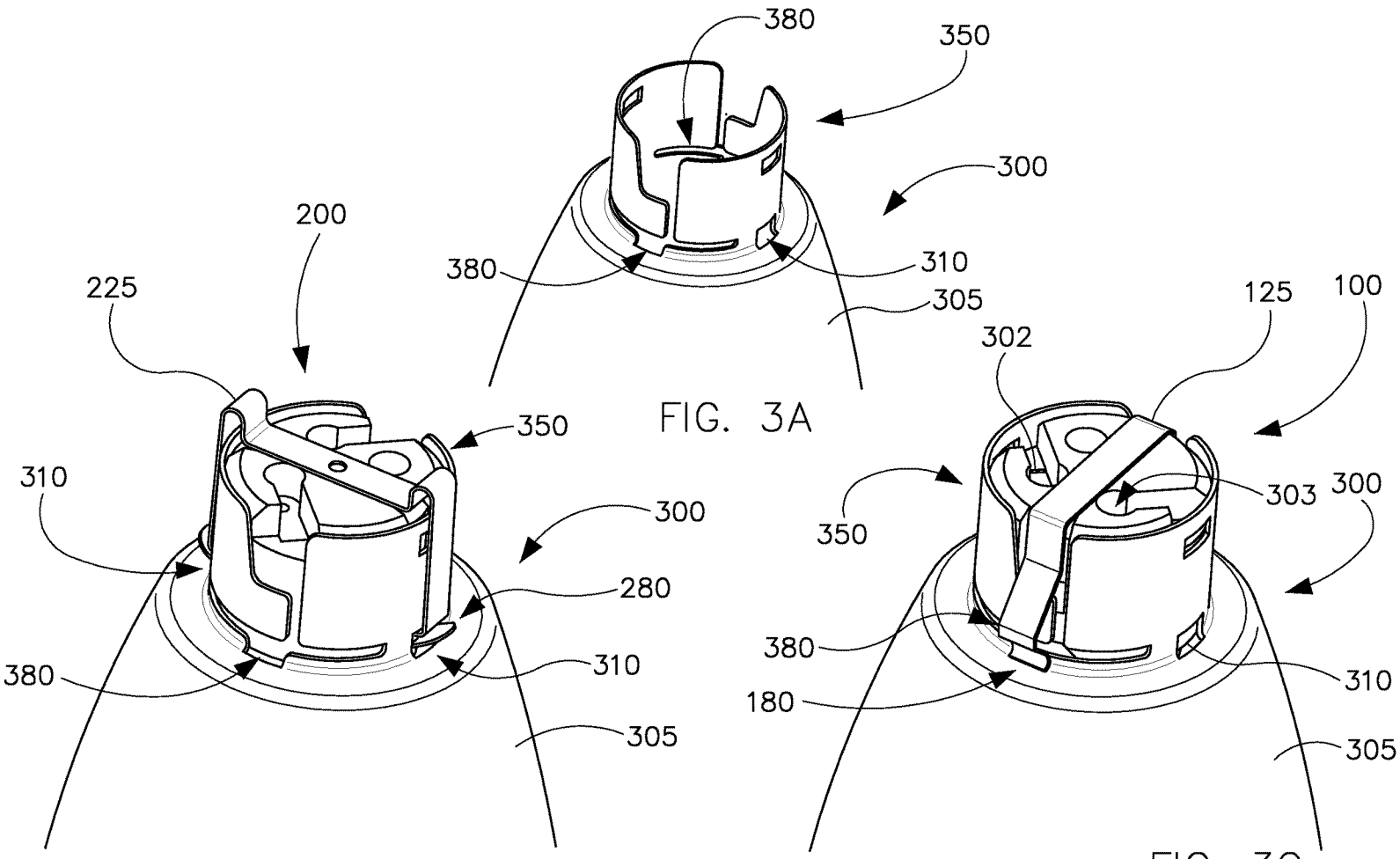
FIGS. 3A, 3B, and 3C (collectively FIG. 3) illustrate a finishing section of a lighting fixture comprising a receptacle that is compatible with multiple types of lamp socket springs according to some example embodiments.

As best seen in FIG. 3C, corresponding electrical contacts are located in recesses 302, 303 in the body 105 of the lamp socket 100, opposite the threaded lamp aperture 150. As illustrated in FIG. 1, electrical wiring 135 receives electricity from an external power source (typically, but not necessarily alternating current (AC)) for transfer to the electrical contacts of the lamp socket 100 and ultimately to the lamp (not illustrated) that is inserted in the lamp aperture 150. The body 105 of the lamp socket 100 provides structural support for the lamp (when installed) and electrical insulation between the electrical contacts.

Forward portions 180 of the spring clip 125 are splayed out, whereas a rear portion 185 of the spring clip 125 adjoins the side 190 of the lamp socket body 105. As illustrated, the forward portions 180 of the spring clip 125 comprise curved ends 181 having a hairpin shape. The spring clip 125 is typically attached to the lamp socket body 105 with a fastener at the rear of the body, for example using a rivet, cleat, screw, or other appropriate device. The lamp socket 100 illustrated in FIG. 1 will be referred to below, without limitation, as a type 1 socket 100.

Figure 2C:
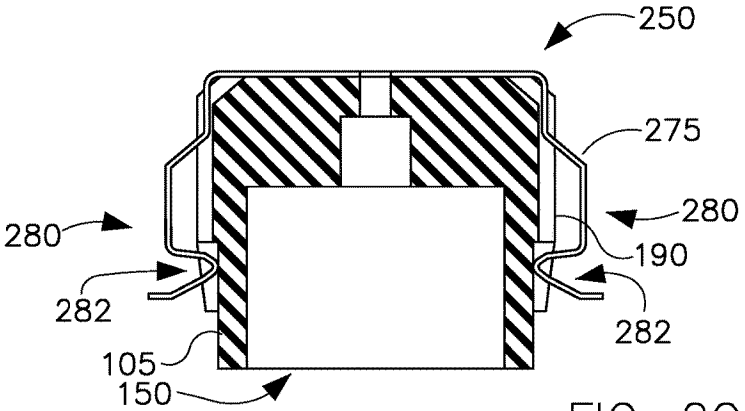
Figure 2B:
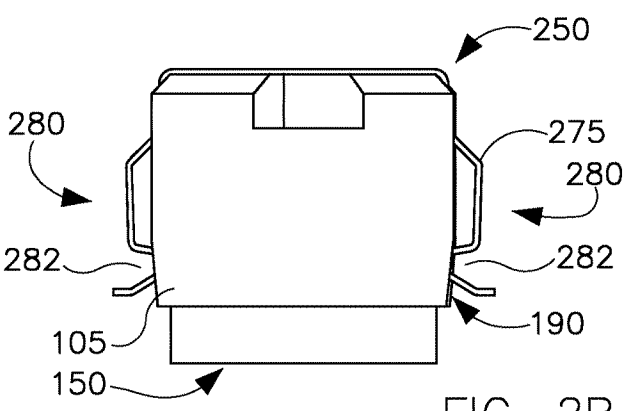

Turning now to FIG. 2, this figure illustrates two variations of lamp sockets 200, 250 that comprise spring clips 225, 275, the forward portions 280 of which adjoin and press against the lamp socket body 105. As illustrated, the forward portions 280 of the spring clips 225, 225 comprise curved ends 281, 282 having a hairpin shape. In some example embodiments, the lamp socket 200 illustrated in FIG. 2A, the lamp socket 250 illustrated in FIGS. 2B and 2C, and the lamp socket 100 illustrated in FIG. 1 utilize a common lamp socket body 105. Other embodiments may utilize different body forms.

FIG. 2A illustrates the first of the two example spring clip variations. FIGS. 2B and 2C illustrate the second of the two example variations, with FIG. 2C providing a representative cross sectional view. In both illustrated variations, the spring clips 225, 275 are attached at the lamp socket rear and utilize spring action to exert force against the side 190 of the lamp socket 105. Thus as illustrated, the spring clips 225, 275 are in tension. Accordingly, if the spring clips 225, 275 were to be removed from their respective lamp sockets 200, 250, and thus placed in a relaxed state, spring action would flex the forward portions 280 of the spring clips 225, 275 inward (towards one another).

The versions illustrated in FIGS. 2A, 2B, and 2C (and in FIG. 1) will be referenced, by example and without limitation, in subsequent illustrations and in the text that follows. The lamp sockets 200, 250 illustrated in FIG. 2A and in FIGS. 2B and 2C can be the same lamp socket 100 as illustrated in FIG. 1 except that the splayed out spring clip 125 is replaced with a different spring clip. The lamp socket illustrated in FIG. 2A will be referred to below, without limitation, as a type 2 socket 200. Meanwhile, the embodiment illustrated in FIGS. 2B and 2C can be referred to, without limitation, as a type 3 socket 250.

Turning now to FIG. 3, this figure provides illustrations of a lighting fixture 300 comprising a receptacle 350 that is compatible with type 1 and type 2 sockets 100, 200. FIG. 3A illustrates the lighting fixture 300, which may be characterized as finishing section or as recessed lighting, and its receptacle 350. That is, the lighting fixture 300 can comprise a finishing section. The lighting fixture 300 may further comprise a reflector for directing emitted light. As illustrated, the finishing section 305 comprises a hollow, tapered cavity through which light flows out of a light-emitting aperture. The inner surface of the finishing section 305 (not visible) may be coated with a diffusely reflective paint or other material or may be shiny to promote specular reflection. The finishing section 305 may be formed from a thin sheet of metal, for example aluminum.

FIG. 3B illustrates an example of how the forward portions 280 of the spring clip 225 of a type 2 socket 200 can engage the receptacle 350. As illustrated, the spring clip 225 retains the socket 200 in the receptacle 350 by spring action pressing radially inward. The receptacle 350 comprises two diametrically opposed openings 310 in which the forward portions 280 of the spring clip 225 are disposed. To position the forward portions 280 of the spring clip 225 into the receptacle openings 310, a person typically slides the socket 200 forward into the receptacle 350. The forward portions 280 of the spring clip 225 then protrude inward through the openings 310 and may make contact with the socket 200, resulting in retention.

FIG. 3C illustrates an example of how the spring clip 125 of a type 1 socket 100 can engage with the receptacle 350. In the illustrated example, the spring clip 125 retains the socket 100 in the receptacle 350 by spring action pressing radially outward against the receptacle 350. More specifically, the receptacle 380 comprises two diametrically opposed groove openings 380 in which the forward portions 180 of the spring clip 125 are disposed. To work the forward portions 180 of the spring clip 125 into those groove openings 380, a person may squeeze (and thus compress) the spring clip 125 and then release the tension. Once the tension is released, the groove openings 380 in the receptacle 350 capture the forward portions 180 of the spring clip 125, and the forward portions 180 press against the groove openings 380, resulting in retention.

Figures 4A, 4B, 4C:
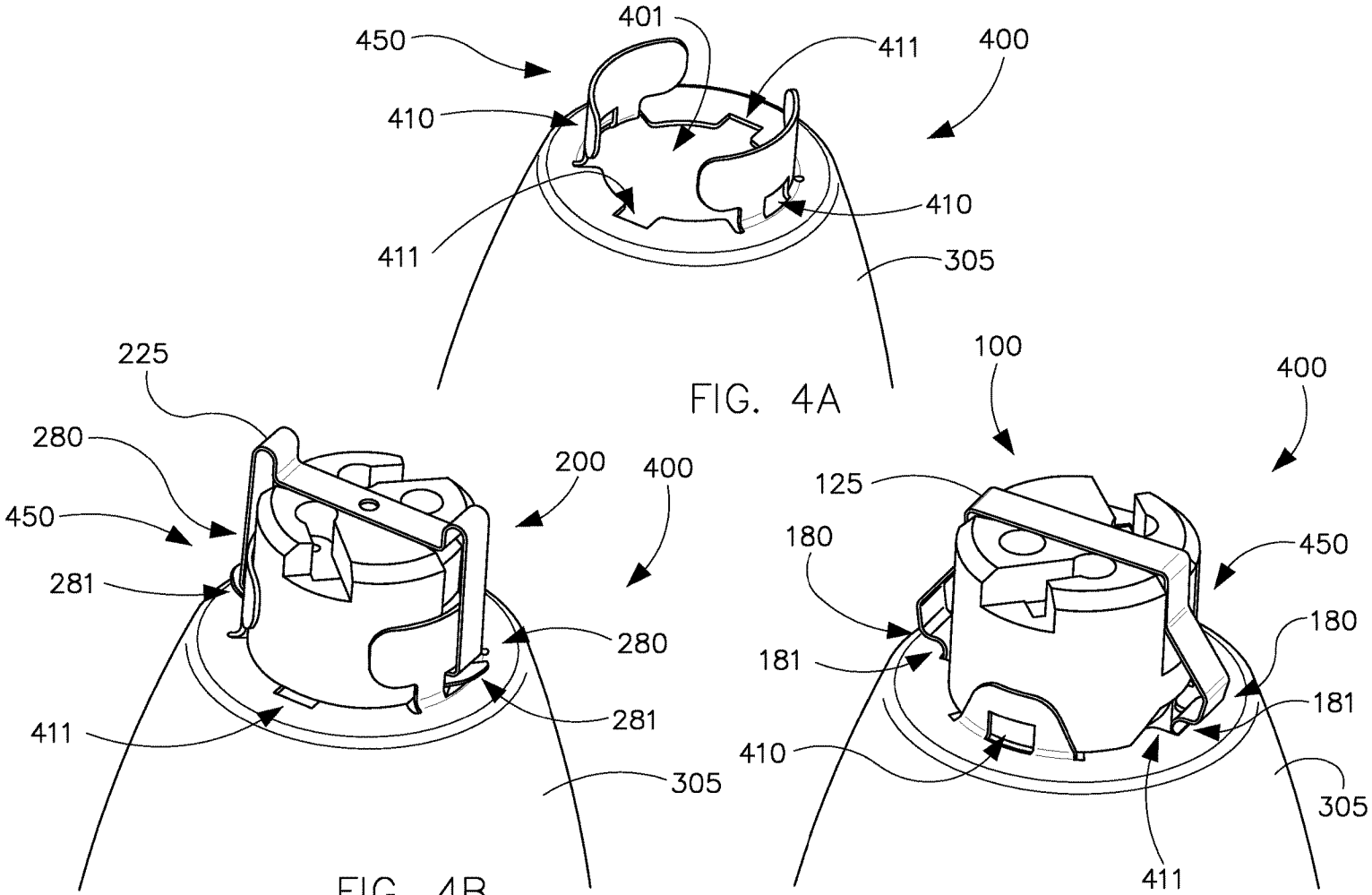
FIGS. 4A, 4B, and 4C (collectively FIG. 4) illustrate another lighting fixture having another receptacle that is compatible with multiple types of lamp socket springs according to some example embodiments.

Turning now to FIG. 4, this figure provides illustrations of another example lighting fixture 400 having another example receptacle 450 that is compatible with type 1 and type 2 sockets 100, 200. FIG. 4A illustrates the lighting fixture 400 without a socket 100, 200. As further discussed below, FIGS. 4C and 4B illustrate the lighting fixture 400 with type 1 and type 2 sockets 100, 200 inserted and captured.

FIG. 4B illustrates an example of how the spring clip 225 of a type 2 socket 200 can engage the receptacle 450. As discussed above with reference to FIG. 3B, spring force urges the forward portions 280 of the spring clip 225 to press radially inward. Each forward portion 280 comprises a curved end 281, and those curved ends 281 protrude into respective openings 410 in the receptacle 450. Accordingly, once the type 2 socket 200 is inserted in the receptacle 450, the curved ends 281 of the spring clip 225 retain the insertion. The socket 200 can be removed from the receptacle 450 by backing the socket 200 out of the receptacle 450. In some embodiments, a person may gently pull the forward portions 280 of the spring clip 225 (including the curved ends 281) apart to facilitate extraction of the socket 200 from the receptacle 450.

FIG. 4C illustrates an example of how the spring clip 125 of a type 1 socket 300 can engage the receptacle 450. As discussed above with reference to FIG. 3C, spring action urges the forward portions 180 of the spring clip 125 to flex outward. Each forward portion 180 comprises a curved end 181. The curved ends 181 protrude into and urge outward against respective openings 411 in the receptacle 450. In the illustrated embodiment, the openings 411 comprise notches formed in the periphery of the receptacle 450. That is, the receptacle 450 comprises a major opening 401 in which the socket 100 is positioned, and the major opening 401 comprises two notched openings 411 that are positioned to receive the two spring clip curved ends 181. Accordingly, once the socket 100 is inserted in the receptacle 450 and the spring clip ends 181 are disposed in the notched openings 411, force between those openings 411 and the spring clip curved ends 181 retains the socket 100 in the receptacle 450. The socket 100 can be removed from the receptacle 450 by squeezing the forward portions 180 of the spring clip 125 together and then backing the socket 100 out of the receptacle 450.

Figure 5:
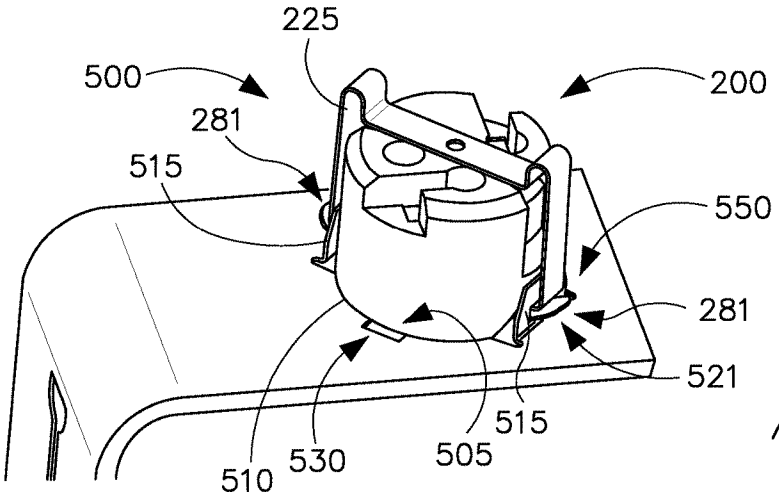
FIG. 5 illustrates a bracket that incorporates a receptacle that is compatible with multiple types of lamp socket springs according to some example embodiments.

Turning now to FIG. 5, this figure illustrates an example bracket 500 of a lighting fixture that incorporates a receptacle 550 that is compatible with type 1 and type 2 of lamp sockets 100, 200. While FIG. 5 illustrates a type 2 socket 200 received by the receptacle 550, the receptacle 550 is further compatible with a type 1 lamp socket 100.

In the illustrated embodiment, the receptacle 550 of the bracket 500 is formed as an aperture 505 in the bracket 500 that is sized to receive both lamp sockets 100, 200. The periphery 510 of the aperture 505 is configured to receive the forward spring clip ends 181, 281 of both socket types. To accept a type 2 socket 200 (as illustrated), the periphery 510 of the aperture 505 comprises two turned up tabs 515, each comprising an opening 521 sized to receive a curved spring clip end 281 pressing inward. To accept a type 1 lamp socket 100, the periphery 510 of the aperture 505 further comprises two notches 530 that are angularly displaced relative to the tabs 515. The notches 530 and tabs 515 may be separated approximately 90 degrees in some embodiments, for example. As discussed above, with respect to FIG. 4C, when a type 1 socket 100 is mounted in the receptacle 550, its spring clip 125 presses radially outward into the notches 530 for retention.

Figure 6A:
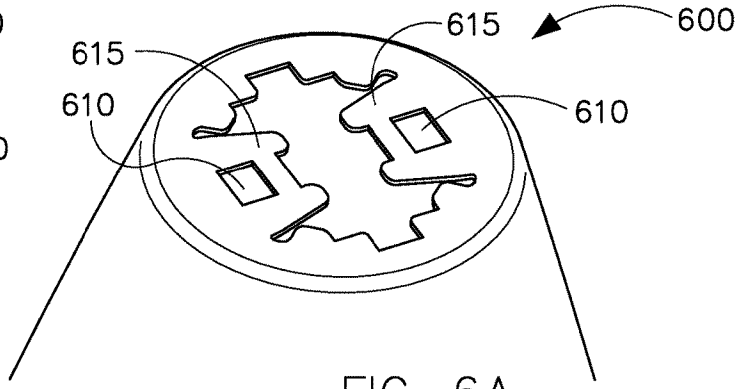
FIGS. 6A, 6B, and 6C (collectively FIG. 6) and FIGS. 7A, 7B, 7C, 7D, 7E, and 7F (collectively FIG. 7) illustrate another lighting fixture comprising another receptacle that is compatible with multiple types of lamp socket springs according to some example embodiments.
Figure 6C:
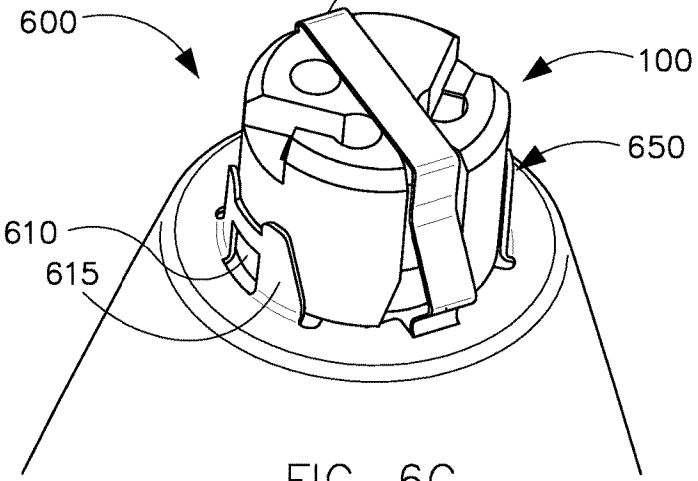
Figure 6B:
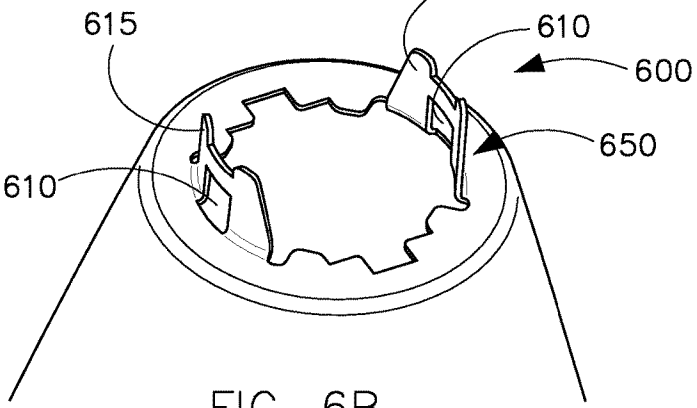

Turning now to FIGS. 6 and 7, these figures provide illustrations of another lighting fixture 600 having another receptacle 650 that is compatible with type 1, type 2, and type 3 lamp sockets 100, 200, 250. FIG. 6A illustrates the lighting fixture 600 with the tabs 615 of the receptacle 650 in a pre-formed configuration before bending to a final shape as is shown in FIG. 6B, for example. FIG. 6B illustrates the fixture with the receptacle tabs 615 in a final form, so that the fixture 600 is configured to receive multiple types of lamp sockets 100, 200, 250. FIG. 6C illustrates how the receptacle accommodates a type 1 socket.

FIGS. 7A, 7B, 7C, 7D, 7E, and 7F are a series of progressive illustrations showing how the receptacle 650 can receive a type 3 lamp socket 250. As shown in these figures, spring force of the spring clip 275 presses the forward portion 280 of the spring clip 275 (particularly the curved ends 282) against the side 190 of the socket 250. As the socket 250 moves into the receptacle 650, the forward, curved ends 282 ride over the receptacle tab 615 and into an aperture 610 in the tab 615, thereby retaining the socket 250 in the receptacle 650. Representative feature positions and dimensions for the illustrated embodiment will be further discussed below with reference to FIGS. 12-17.

At FIG. 7A, the receptacle 650 is configured to receive a socket 250.

At FIG. 7B, the socket 250 is aligned with the receptacle 650 in preparation for insertion. The axis of the socket 250 and the axis of the receptacle 650 are aligned to one another. Additionally, the spring clip 275 of the socket 250 is rotationally aligned with the corresponding features of the receptacle 650 that will engage with one another for retention.

At FIG. 7C, the socket 250 has been moved forward partially into the receptacle 650. The curved ends 282 of the spring clip 275 are positioned to align with corresponding notches 612 in the receptacle 650 and to seat into the corresponding openings 610 in the receptacle 650 once the socket 250 is fully inserted in the receptacle 650.

At FIG. 7D, the socket 250 has been moved further forward. The leading edges of the tabs 615 of the receptacle 650 have radially displaced the curved ends 282 of the spring clip 275. The socket 250 has yet to advance sufficiently for the curved ends 282 of the spring clip 275 to protrude into the openings 610 of the tabs 615.

At FIG. 7E, the socket 250 has been moved even further forward. The curved ends 282 of the spring clip 275 are aligned with the openings 610 in the tabs 615 and are positioned to seat in those openings 610 once the socket 250 is fully inserted in the receptacle 650.

At FIG. 7F, the socket 250 is fully inserted in the receptacle 650. The curved ends 282 of the spring clip 275 are seated in the openings 610, and the socket 250 is retained by as discussed above.

Turning now to FIGS. 8 and 9, these figures provide illustrations for another example lighting fixture 800 comprising a two-position receptacle 850 that is compatible with both type 1 and type 3 lamp sockets 100, 250. As illustrated and further discussed below, the two-position receptacle 850 provides a forward socket position and a rear socket position. Accordingly, the lighting fixture 800 provides a flexible configuration that supports multiple light source types and user preferences. The illustrated lighting fixture 800 may be installed in a ceiling for recessed lighting, for example.

Figure 8B:
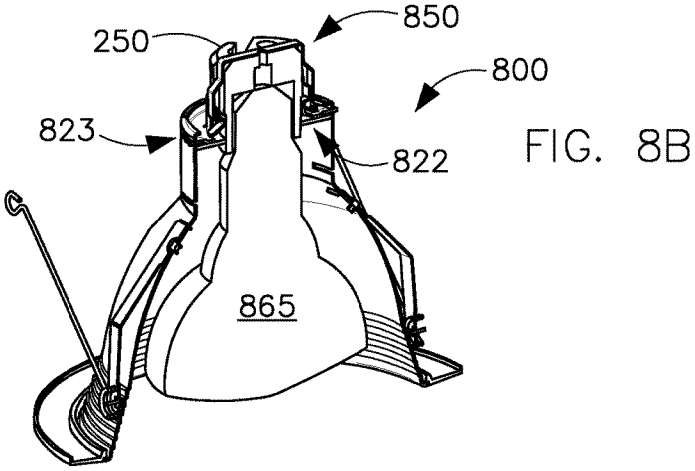
FIGS. 8A, 8B, 8C, and 8D (collectively FIG. 8) and FIGS. 9A, 9B, 9C, 9D, and 9E (collectively FIG. 9) illustrate another lighting fixture comprising a two-position receptacle that is compatible with multiple types of lamp socket springs according to some example embodiments.
Figure 8D:
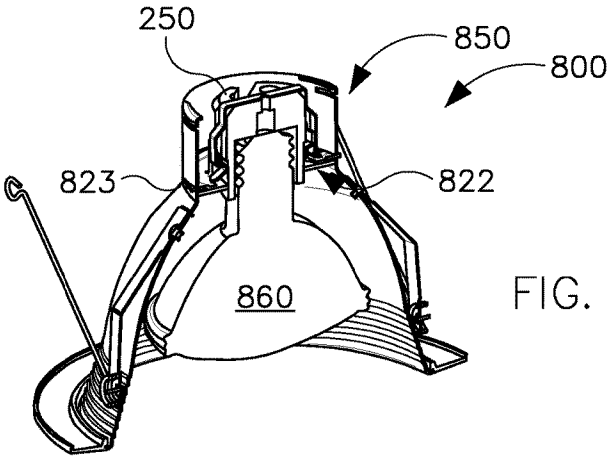
Figure 8A:
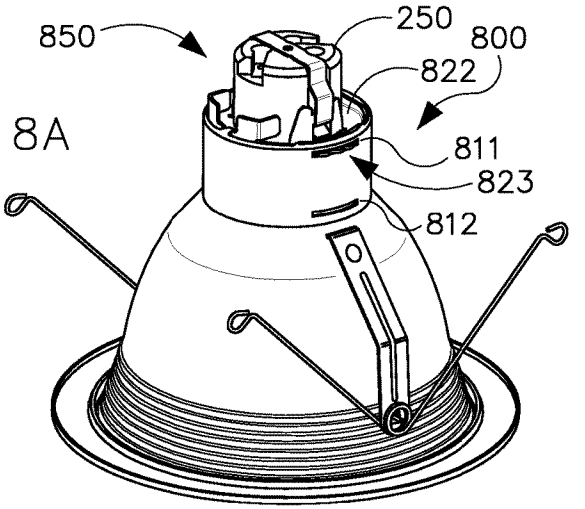

FIGS. 8A and 8B depict the socket 250 in the rear position, where it accommodates a long light bulb 865. FIG. 8A illustrates a side perspective view, while FIG. 8B illustrates a cutaway view.

At its rear, the lighting fixture 800 comprises rear slots 811 and forward slots 812 respectively providing the rear socket position and the forward socket position. The two-position receptacle 850 further comprises an insert 822 with peripheral protrusions 823 that seat in the rear slots 811 and the forward slots 812 to provide the rear and forward socket positions.

Figure 8C:
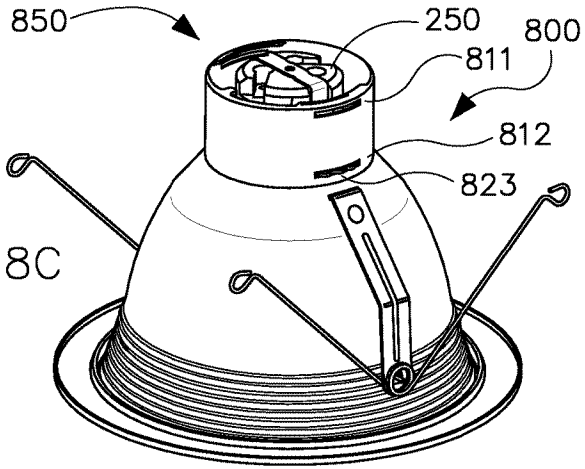

FIGS. 8C and 8D are, respectively, a side perspective view and a cutaway view that show the socket 250 in the forward position. As illustrated, a short bulb 860 is mounted in the socket 250. Accordingly, the two-position format enables the receptacle 850 to accept short bulbs 860 and long light bulbs 870. FIGS. 9A, 9B, 9C, 9D, and 9E illustrate progressive disassembly of the lighting fixture 800, showing representative receptacle components.

Figure 9E:
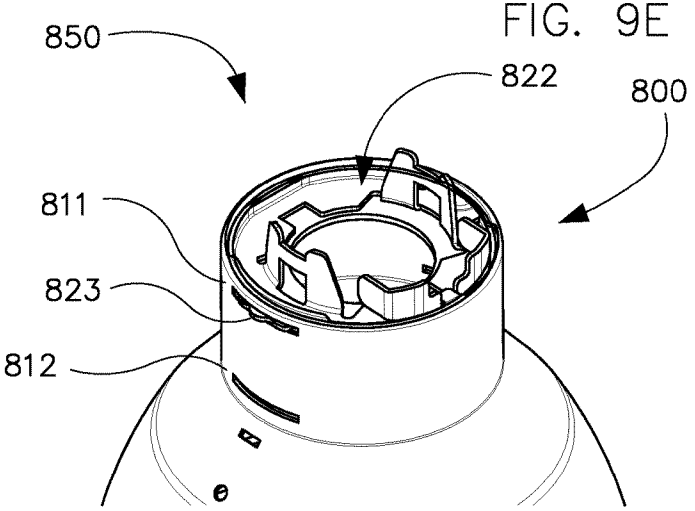
Figure 9A:
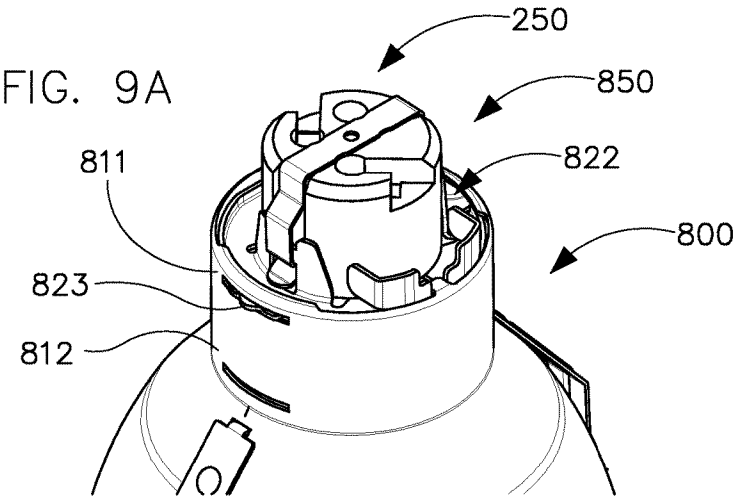
Figure 9D:
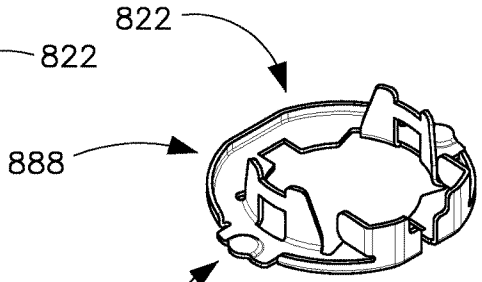
Figure 9C:
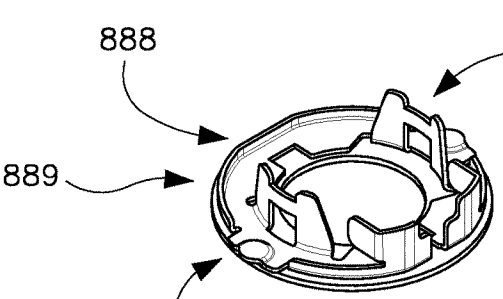
Figure 9B:
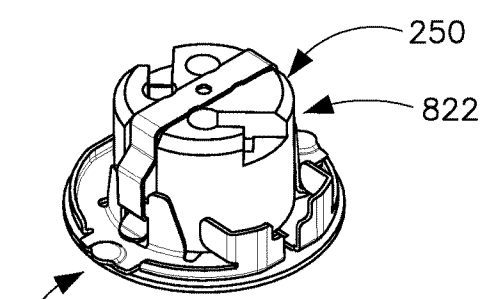

FIG. 9A illustrates the socket 250 installed in the receptacle 850 of the lighting fixture 800. FIG. 9B illustrates the socket 250 and the insert 822 of the receptacle 850 separated from the lighting fixture 800. FIG. 9C illustrates the insert 822 of the receptacle 850 with the socket 250 removed. As illustrated, the insert 822 comprises a rear component 888 and a forward component 889. FIG. 9D illustrates the rear component 888 of the insert 822, without the forward component 889. FIG. 9E illustrates the receptacle 850 intact in the lighting fixture 800 with the socket 250 removed.

FIGS. 10 and 11 provide illustrations for another example lighting fixture 1000 that comprises a two-position receptacle 1045 that is compatible with type 1 and type 3 lamp sockets 100, 250. The example two-position receptacle 1045 provides a forward socket position and a rear socket position. Accordingly, the lighting fixture 1000 provides a flexible configuration that supports multiple light sources and user preferences.

The illustrated two-position receptacle 1045 comprises an insert 1055 that retains the lamp socket 250 as discussed above with reference to prior figures. The insert 1055 is readily moved to two positions in a tube 1050 at the rear of the lighting fixture 1000. The tube 1050 comprises a pair of apertures 1075 that each has an enlarged rear area and an enlarged front area forming an I-shaped or dog-bone shaped opening. The insert 1055 comprises spring members 1085 that are disposed in the apertures 1075. In the forward and rear positions, each spring member 1085 respectively seats in the forward and rear enlarged areas of an aperture 1075.

Figure 10C:
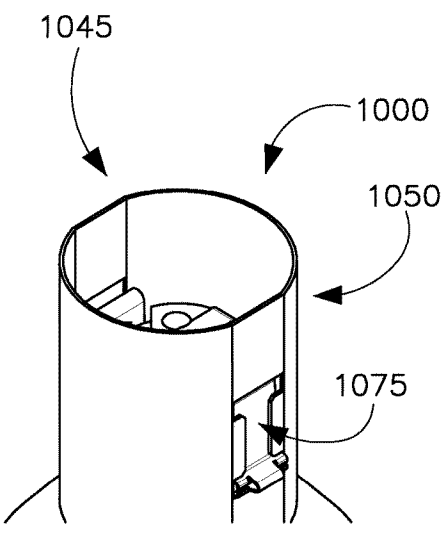
FIGS. 10A, 10B, and 10C (collectively FIG. 10) and FIGS. 11A and 11B (collectively FIG. 11) illustrate another lighting fixture having another two-position receptacle that is compatible with both types of lamp socket springs according to some example embodiments.
Figure 10B:
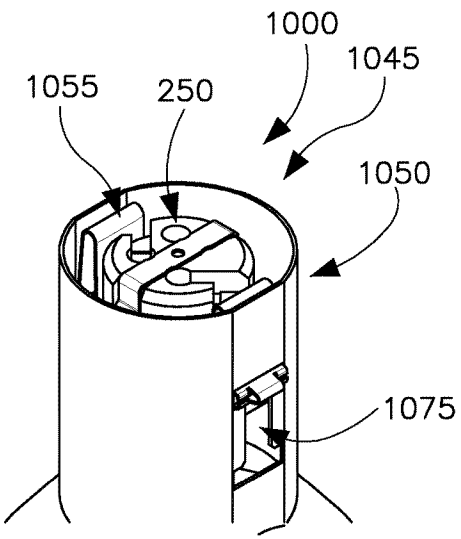
Figure 10A:
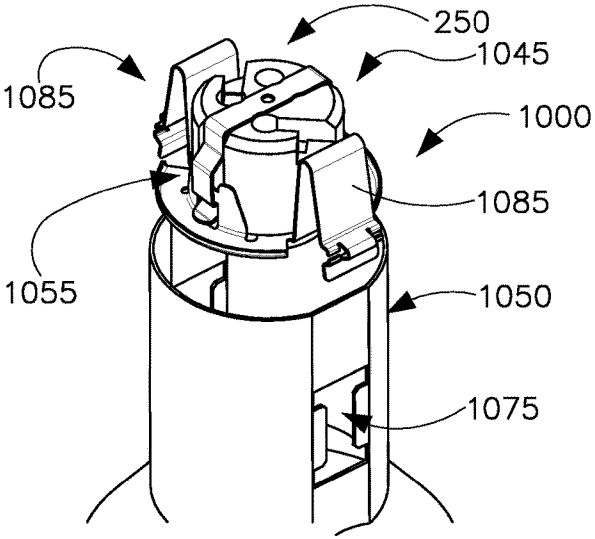
Figure 11B:
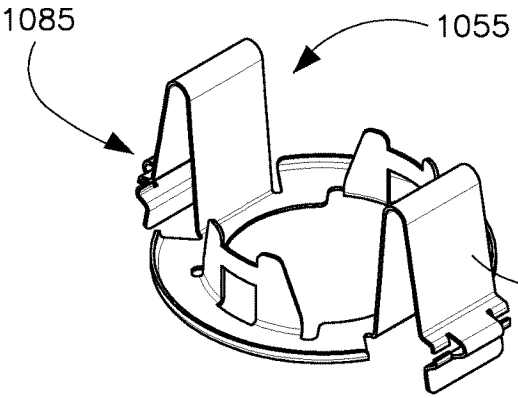
Figure 11A:
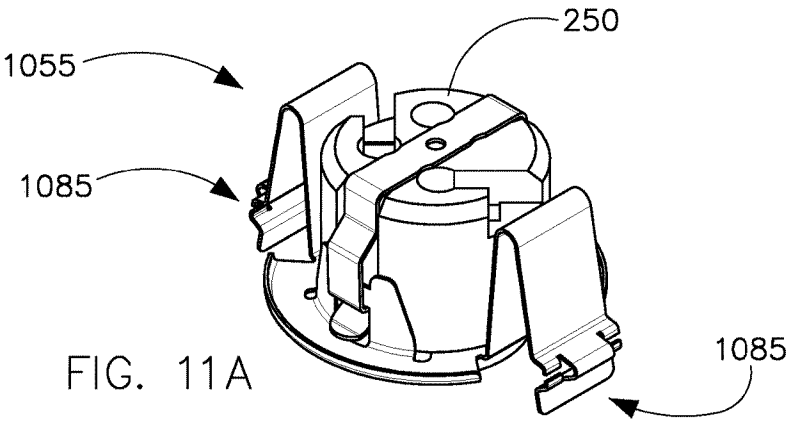

FIGS. 10A, 10B, and 10C respectively illustrate the assembly of the insert 1055 and socket 250 disposed outside the rear of the light fixture 1000, in the rear position of the receptacle 1045, and in the forward position of the receptacle 1045. FIGS. 11A and 11B illustrate breakdown of the socket assembly elements comprising the insert 1055 and the lamp socket 250.

FIG. 10A illustrates the socket 250 and insert 1055 positioned for mounting in the fixture. FIG. 10B illustrates the socket 250 and insert 1055 assembly in the rear position of the fixture 1000. FIG. 10C illustrates the socket 250 and insert 1055 assembly in the forward position of the fixture 1000.

FIG. 11A illustrates the socket 250 and insert 1055 assembled, while in FIG. 11B, the insert 1055 with the socket 250 removed.

Figure 12:
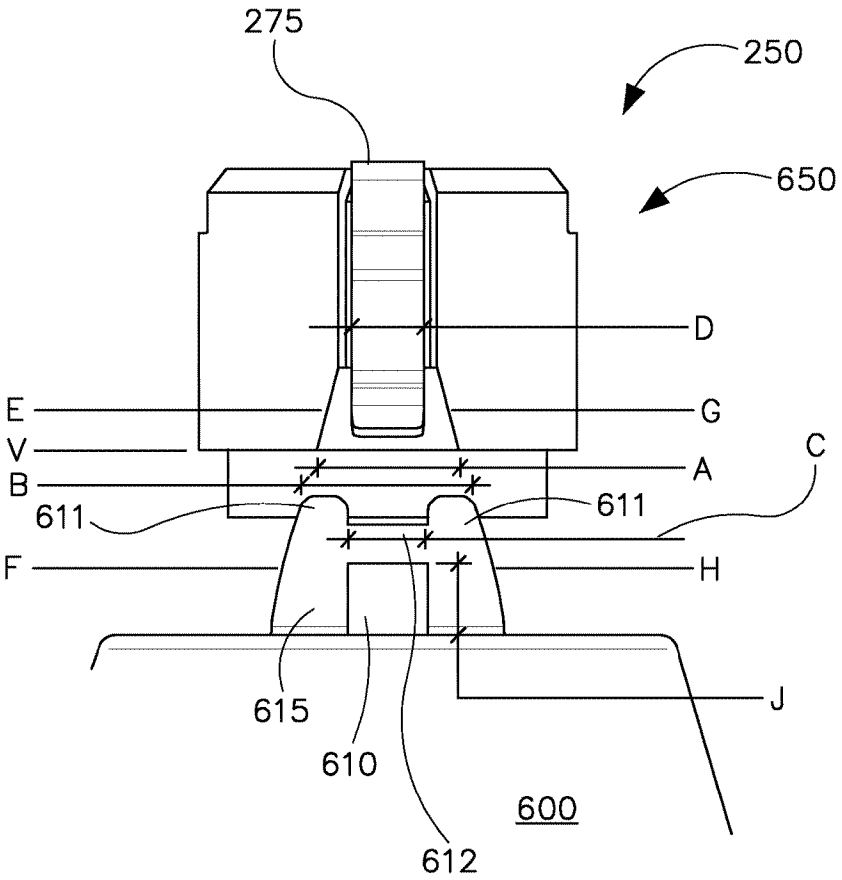
FIG. 12 illustrates representative dimensional and configuration information for a socket and receptacle in a stage of assembly generally corresponding to a view of FIG. 7 according to some example embodiments.
Figure 13:
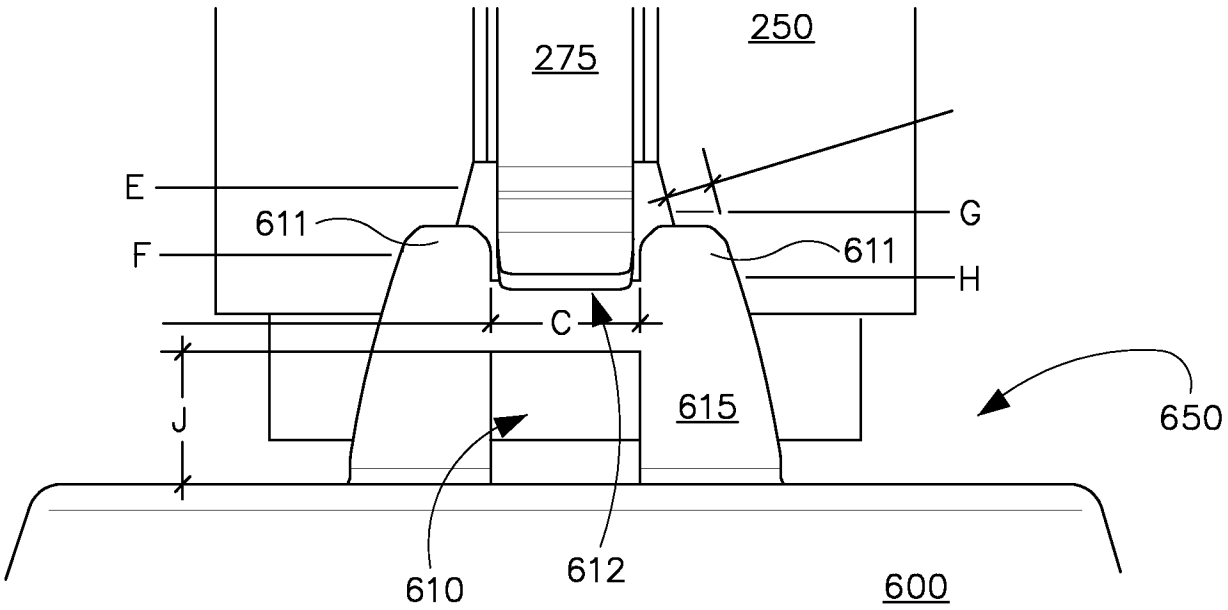
FIG. 13 illustrates representative dimensional and configuration information for a socket and receptacle in a stage of assembly generally corresponding to a view of FIG. 7 according to some example embodiments.
Figure 14:
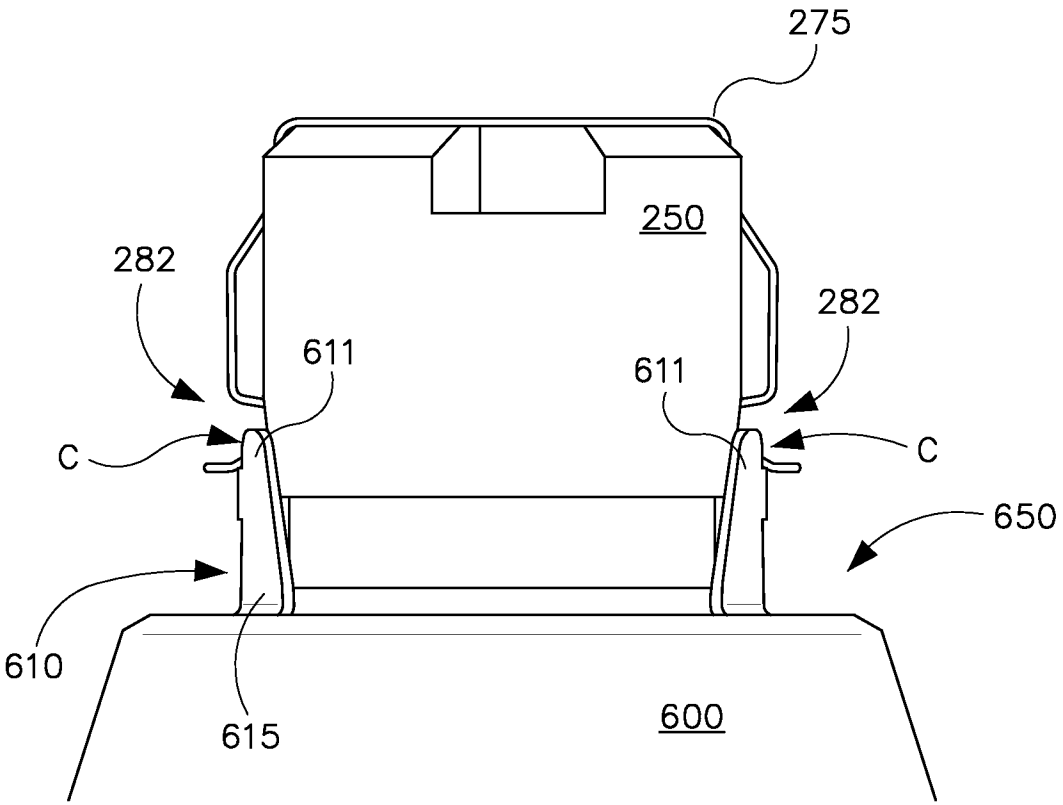
FIG. 14 illustrates representative dimensional and configuration information for a socket and receptacle in a stage of assembly generally corresponding to a view of FIG. 7 according to some example embodiments.
Figure 15:
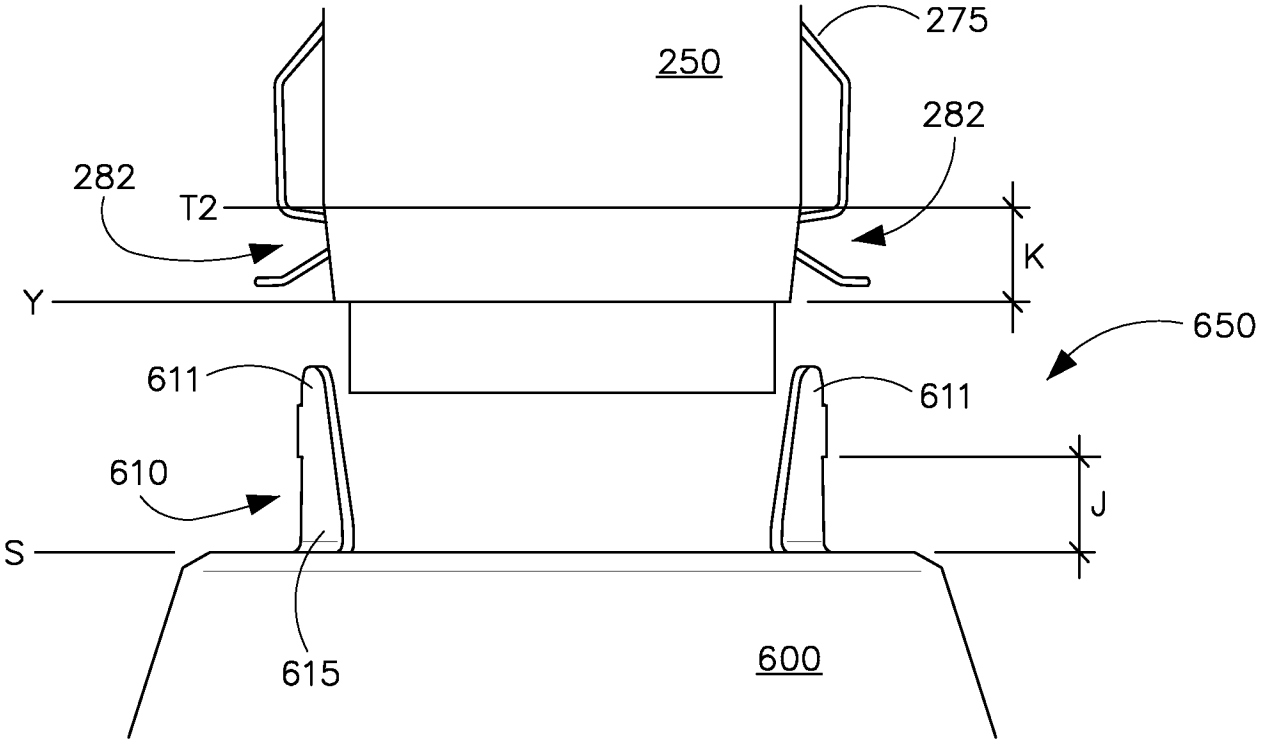
FIG. 15 illustrates representative dimensional and configuration information for a socket and receptacle in a stage of assembly generally corresponding to a view of FIG. 7 according to some example embodiments.

Turning now to FIGS. 12-17, example dimensional and example configuration information useful for some representative embodiments is provided for the socket 250 and the receptacle 650 of the lighting fixture 600 illustrated in FIG. 7. However, in many cases, embodiments will deviate from this representative information, according to application parameters, user preferences, or other factor or consideration FIGS. 12 and 15 illustrate orthogonal views of the socket 250 positioned outside the receptacle 650 generally corresponding to the configuration illustrated in FIG. 7B as discussed above.

FIGS. 13 and 14 illustrate orthogonal views of the socket 250 positioned partially into the receptacle 650 in general correspondence with the configuration illustrated in FIG. 7C as discussed above. In the illustrated configuration, the curved ends 282 of the spring clip 275 are positioned above notches 612 of the tabs 615, where each notch 612 is formed between two upper tab extensions 611.

Figure 16:
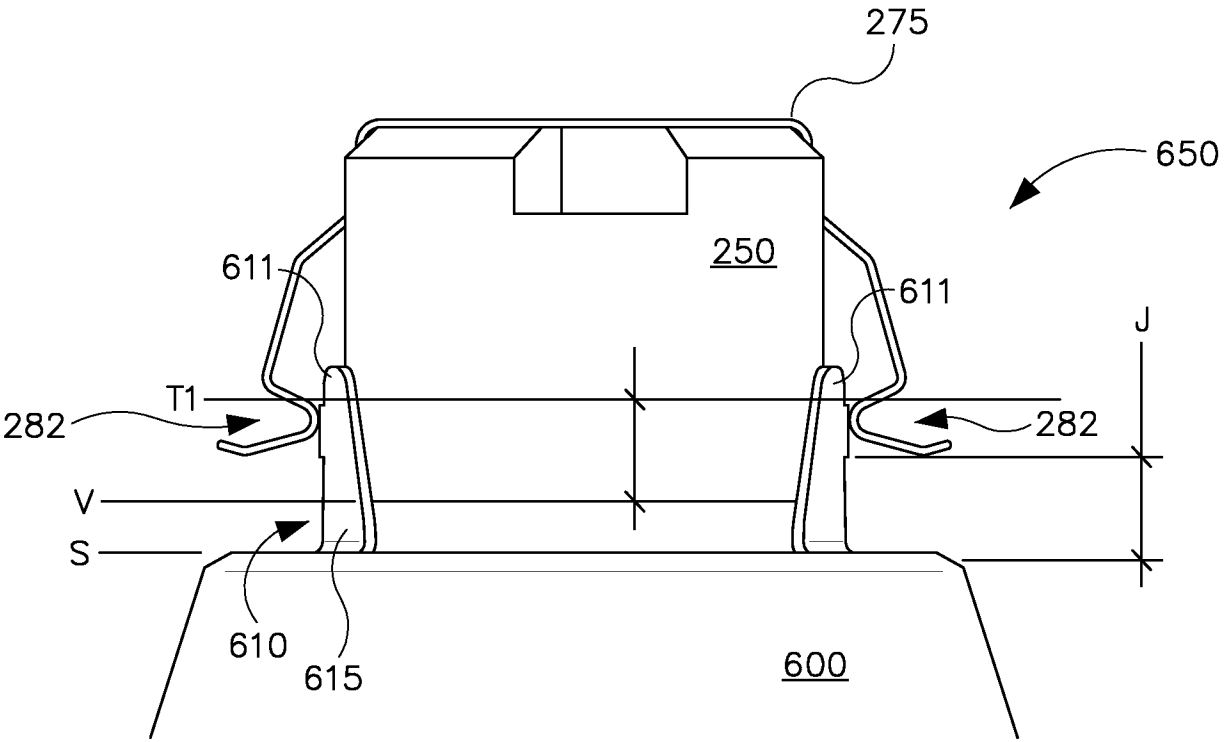
FIG. 16 illustrates representative dimensional and configuration information for a socket and receptacle in a stage of assembly generally corresponding to a view of FIG. 7 according to some example embodiments.

FIG. 16 illustrates the socket 250 partially inserted in the receptacle 650 generally corresponding to the configuration illustrated in FIG. 7E as discussed above. In the illustrated configuration, each curved end 282 of the spring clip 275 is positioned over the tab 615, between a notch 612 and an opening 610 of the tab 615.

Figure 17:
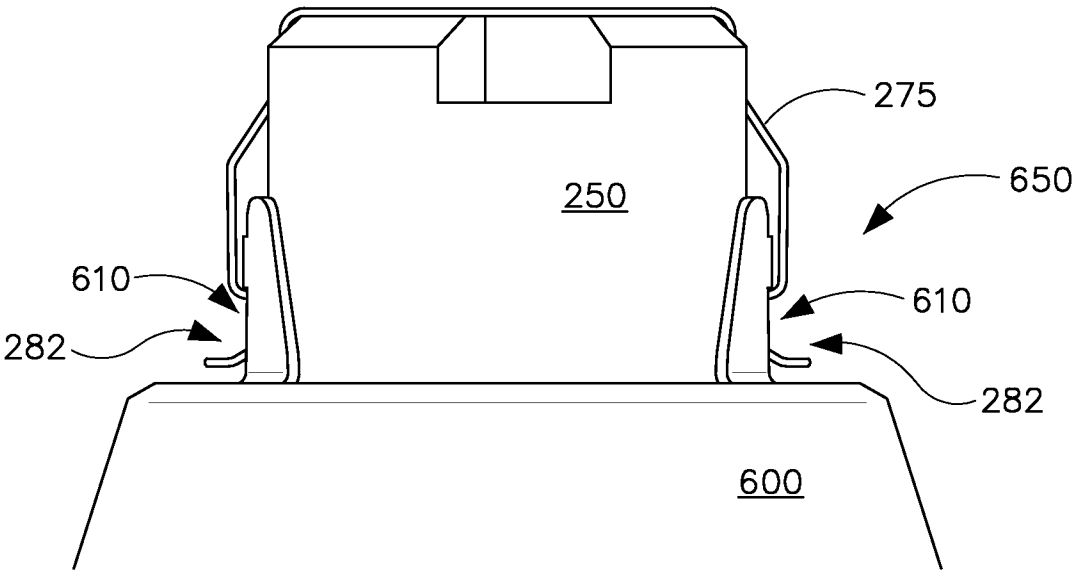
FIG. 17 illustrates representative dimensional and configuration information for a socket and receptacle in a stage of assembly generally corresponding to a view of FIG. 7 according to some example embodiments.

FIG. 17 illustrates the socket 250 fully inserted in and retained by the receptacle 650.

FIGS. 12-17 are annotated with representative dimensional indications as discussed below and without limitation. "A" represents an example width of a lead-in groove in the socket 250 associated with the spring clip 275 in accordance with some embodiments. "B" represents an example width between outer edges of two upper tab extensions 611. "C" represents an example width of the notch 612 and the opening 610 of the tabs 615 in accordance with some embodiments. "D" represents an example width of the spring clip 275 in accordance with some embodiments. "E" and "G" represent example contact between the curved ends 282 of the spring clip 275 and the body 105 of the socket 250 in accordance with some embodiments. "F" and "H" represent example widths of the tabs 615 at the top of the opening 610 in accordance with some embodiments. "G" and "H" represents example edge dimensions for the tabs 615 in accordance with some embodiments. "J" represents an example height of the opening 610 in accordance with some embodiments. "K" represents an example distance of the curved end 282 of the spring clip 275 above the shoulder V of the socket 250 in accordance with some embodiments. "L" represents an example distance between the features T1 and V in accordance with some embodiments. "V" represents an example shoulder of the socket 250 in accordance with some embodiments. "S" represents a rear shoulder surface for the lighting fixture 600 in accordance with some embodiments. FIG. 12 provides some representative dimensional relationships that may be utilized in certain embodiments of the socket 250 and the receptacle 650. However, many suitable designs will deviate from the relationships. In certain example embodiments the following equations may be practiced:

$$B>A \qquad \text{I.}$$

$$(C-D)/2<(B-A)/2 \qquad \text{II.}$$

In some embodiments, edge E may be substantially parallel to edge F. In some embodiments, edge G may be substantially parallel to edge H.

While B may be less than A in some embodiments, there may be a tendency for edge F to be caught within edge E, and edge H may be caught within edge G. The indicated parallel edge conditions can facilitate socket installation.

FIG. 13 illustrates further example configurations where B>A with edge H overlapping edge G, and edge F overlapping edge E.

FIG. 14 illustrates how socket-to-receptacle assembly can be guided by features on the lighting fixture 600 or finishing section in some embodiments. As illustrated, the socket 250 is partially inserted in the receptacle 650, with its spring clip 275 aligned with the corresponding features of the receptacle 650 for capture upon full insertion. The socket 250 can be centered by the upper tab extensions 611 and guided by the notches 612.

FIG. 15 illustrates the socket spring clip 275 in free stage and reflector/finishing section interface for some embodiments. As illustrated, the socket 250 is aligned for insertion in the receptacle 650, but has yet to be inserted. As illustrated, T2 is the spring upper transition point; J is the opening height measured from surface S; K is the distance from the socket landing surface to the spring upper transition point; S is the reflector (or finishing section) socket interface surface; and V is the socket ledge. In some example embodiments, K</=J.

FIG. 16 illustrates the socket spring clip 275 in a splayed out stage. As illustrated, the socket 250 is partially inserted in the receptacle 650, with the spring clip curved ends 282 riding over the receptacle tab 615 in preparation for seating in the corresponding openings 610 of the receptacle 650 and capture upon full insertion. As illustrated, T1 is the spring lower transition point; J is the opening height measured from surface S; L is the distance from the socket landing surface to the spring lower transition point; S is the reflector (or finishing section) socket interface surface; and V is the socket ledge or shoulder. L<J in some example embodiments.

FIG. 17 illustrates an installed socket 250 according to some example embodiments. As illustrated, the socket 250 is fully inserted in the receptacle 650. The spring clip ends 282 are disposed in the corresponding openings 610 of the receptacle 650 resulting in capture and socket retention.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A system, for mounting a light source, comprising:
- a socket configured to receive and supply electricity to the light source, the socket comprising:
  - a socket body made of an electrically insulating material;
  - a front comprising an aperture for receiving the light source;
  - a rear; and
  - a side extending from the rear to the front; and
- a spring clip attached to the socket, the spring clip comprising a section that extends along the side, the section comprising:
  - a first portion; and
  - a second portion,
  - wherein the first portion is disposed towards the front of the socket relative to the second portion,
  - wherein the second portion is displaced from the side of the socket, and
  - wherein the first portion contacts the side of the socket.

2. The system of claim 1, wherein the second portion urges the first portion into contact with the side of the socket.

3. The system of claim 1, wherein stored energy in the second portion has the first portion pressed against the side of the socket.

4. The system of claim 1, wherein the first portion comprises a hairpin shape adjoining the side of the socket.

5. The system of claim 1, further comprising a finishing section that comprises:
- a receptacle for the socket;
- a light-emitting aperture;
- a surface that extends between the receptacle and the light-emitting aperture and that defines a cavity.

6. The system of claim 5, wherein the cavity is sized to accommodate a light source.

7. The system of claim 5, wherein the receptacle comprises a two-piece insert.

8. The system of claim 5, wherein the receptacle comprises two socket positions, one forward of the other.

9. The system of claim 5, wherein the receptacle is compatible with a second socket that is configured to receive and supply electricity to the light source, the second socket comprising:
- a second socket body made of electrically insulating material;
- a second front comprising a second aperture for receiving the light source;
- a second rear;
- a second side extending from the second rear to the second front; and
- a second spring clip attached to the second socket, the second spring clip comprising a second section that extends along the second side, the second section comprising:
  - a third portion; and
  - a fourth portion,
  - wherein the third portion is disposed towards the second front of the second socket relative to the fourth portion,
  - wherein the third portion is displaced from the second side of the second socket, and
  - wherein the fourth portion is in contact with the second side of the second socket.

10. The system of claim 9, wherein the receptacle comprises a feature that is disposed to capture the third portion of the second spring clip.

11. The system of claim 9, wherein the second spring clip is attached to the second socket at the second rear of the second socket.

12. The system of claim 1, wherein the spring clip is attached to the socket at the rear of the socket.

13. An apparatus comprising
- a receptacle that is compatible with:
  - a first lamp socket that comprises a first spring clip that retains the first lamp socket in the receptacle using outward spring force; and
  - a second lamp socket that comprises a second spring clip that retains the second lamp socket in the receptacle using inward spring force.

14. The apparatus according to claim 13, wherein the receptacle comprises a two-position receptacle.

15. The apparatus according to claim 13, wherein a lighting fixture comprises the receptacle.

16. The apparatus according to claim 13, wherein the first lamp socket applies the outward spring force to a first opening in the receptacle, and
- wherein the second lamp socket applies the inward spring force to a second opening in the receptacle.

17. A lamp socket receptacle, the lamp socket receptacle compatible with a first socket that receives a light source and a second socket that receives the light source, the first socket comprising:

a first front comprising a first aperture for receiving the light source;

a first rear;

a first side extending from the first rear to the first front; and a first spring clip attached to the first socket at the first rear, the first spring clip comprising a first section that extends along the first side, the first section comprising:

a first portion; and a second portion, wherein the first portion is disposed towards the first front of the first socket relative to the second portion, wherein the second portion is displaced from the first side of the first socket, and wherein the first portion is urged against the first side of the first socket by spring action of the second portion, the second socket comprising:

a second front comprising a second aperture for receiving the light source;

a second rear;

a second side extending from the second rear to the second front; and a second spring clip attached to the second socket at the second rear, the second spring clip comprising a second section that extends along the second side, the second section comprising:

a third portion; and a fourth portion, wherein the third portion is disposed towards the second front of the second socket relative to the fourth portion, wherein the fourth portion is in contact with the second side of the second socket, and wherein the third portion is displaced from the second side of the second socket by spring action of the fourth portion.

* * * * *